US005953829A

United States Patent [19]

Van Den Brug et al.

[11] Patent Number: 5,953,829

[45] Date of Patent: Sep. 21, 1999

[54] HAIR STYLING INSTRUMENT

[75] Inventors: Lippe Van Den Brug, Drachten; Albart J. Kip, Groningen, both of Netherlands

[73] Assignee: U.S. Philips Corporation, New York, N.Y.

[21] Appl. No.: 08/990,872

[22] Filed: Dec. 15, 1997

[30] Foreign Application Priority Data

Dec. 24, 1996 [EP] European Pat. Off. ..... 962037123

[51] Int. Cl.[6] ..... A45D 20/12

[52] U.S. Cl. ..... 34/97; 34/98; 34/101; 34/96

[58] Field of Search ..... 34/90, 91, 96, 34/97, 99, 98

[56] References Cited

FOREIGN PATENT DOCUMENTS

94/09669 5/1994 WIPO ..... A45D 20/12

*Primary Examiner*—Henry Bennett
*Assistant Examiner*—Pamela A. Wilson
*Attorney, Agent, or Firm*—Ernestine C. Bartlett

[57] ABSTRACT

A hair styling instrument is provided which includes a housing (8) having a front side (9), formed with at least one passage (10) for heated air. Elongate hair guides (12, 13, 14) project exclusively from the front side (9) of the housing (8) or, at least in the area of the passage (10). Movable hair guides (13) are movable between a first position, in which they project fully from the housing (8), and a second position, in which they project from the housing (8) to a smaller extent than in the first position. With the movable hair guides (13) in the second position the hair styling instrument can be moved through wet tangled hair with a low resistance. Subsequently, when the hair is tidied and drier, a proper grip and hence a satisfactory styling performance is achieved with the movable hair guides (13) in the first position.

14 Claims, 4 Drawing Sheets

HAIR STYLING INSTRUMENT

FIELD OF THE INVENTION

The invention relates to a hair styling instrument comprising a housing having a front side, formed with at least one passage for allowing heated air to pass from the housing to the exterior, and having a rear side opposite the front side, and elongate hair guides which project exclusively from the front side of the housing.

The invention also relates to a hair styling instrument comprising a housing having at least one passage for allowing heated air to pass from the housing to the exterior and, in the area of said at least one passage, elongate hair guides which project over a fixed distance.

BACKGROUND OF THE INVENTION

Such hair styling instruments are known from WO-A-94/09669. Such hair styling instruments are generally used for drying and styling the hair (particularly long hair) after washing. By means of the instrument the hair is then combed and/or brushed by repeatedly moving the hair guides through the hair, from the proximal ends of the hair to the distal ends of the hair. At the same time hot air produced by a dryer unit is blown into the hair via the passages. Thus, the hair is dried during combing and brushing.

A problem which occurs during use of such hair styling instruments is that at the beginning, while the hair is still comparatively wet and tangled, it is difficult to move the instrument through the hair. As the hair becomes drier the problem arises that the shape assumed by the hair (the hair-style) is more difficult to control.

In order to provide different hair-styling facilities for users having different types of hair it is known to include various accessories in hair styling systems, which accessories may comprise hair guides or may be adapted for use in combination with combs and brushes without drying functions. However, a larger number of attachments lead to higher production, packaging and distribution costs and is annoying for the user because these attachments require storage space and changing the attachments is inconvenient. For travellers bringing along a large number of attachments is particularly inconvenient.

Moreover, hair styling instruments of another type are known, also as accessories for a hair styling system, i.e. hair styling instruments in the form of curling brushes. Curling brushes comprise hair guides which project from a circumferential surface of a substantially cylindrical housing and which, all together, are wholly retractable in order to obtain a circumferential surface without any projections. This makes it possible to first wind hair around the circumferential surface by means of the hair guides in the projecting positions, by twisting the instrument substantially about its central axis and, subsequently, once the hair has been heated, retracting the hair guides and withdrawing the housing with the fully retracted hair guides from the hair in an axial direction. Thus, curling brushes are intended specifically for curling the hair in a specific manner and do not provide a solution for problems arising from differences in the behavior between wet and drier hair.

SUMMARY OF THE INVENTION

It is an object of the invention to mitigate the problems pointed out hereinbefore by providing a hair styling instrument which is easier to move through the hair over a larger drying range and which provides satisfactory styling control.

To this end, the hair styling instrument in accordance with the invention is characterized in that at least a plurality of said hair guides is movable between a first position, in which these hair guides project fully from the housing, and at least a second position, in which these hair guides project from the housing at least to a smaller extent than in said first position.

Since the hair guides or at least the further hair guides are movable out of the projecting first position, the number of fully projecting hair guides and the fineness of the hair guide structure can be adapted very rapidly to the humidity and the tangled condition of the hair. When the hair is still very wet it can be treated with a coarse hair guide structure or, if applicable, without any projecting hair guides, thereby avoiding problems in moving the instrument through the hair. Once the hair has been pre-ordered and has dried to some extent the hair-style can be controlled properly with a finer hair guide structure, which is obtained by moving the retracted hair guides into projecting positions, because the finer hair guide structure provides a better grip on the hair. Thus, the hair styling instrument provides a satisfactory performance when styling wet hair as well as dry hair and when styling (still) tangled hair as well as ordered hair.

The hair styling instrument can be constructed, for example, as an attachment to be fitted onto a dryer unit, as a one-piece hair dryer, or as an assembly of a dryer unit with an attachment connected thereto.

BRIEF DESCRIPTION OF THE DRAWINGS

The invention will be described in more detail hereinafter with reference to embodiments given by way of examples, with reference to the drawings. In the drawings.

Like parts of different embodiments shown in the drawings bear identical reference numerals.

DETAILED DESCRIPTION OF THE PREFERRED EMBODIMENTS

Figure 1:
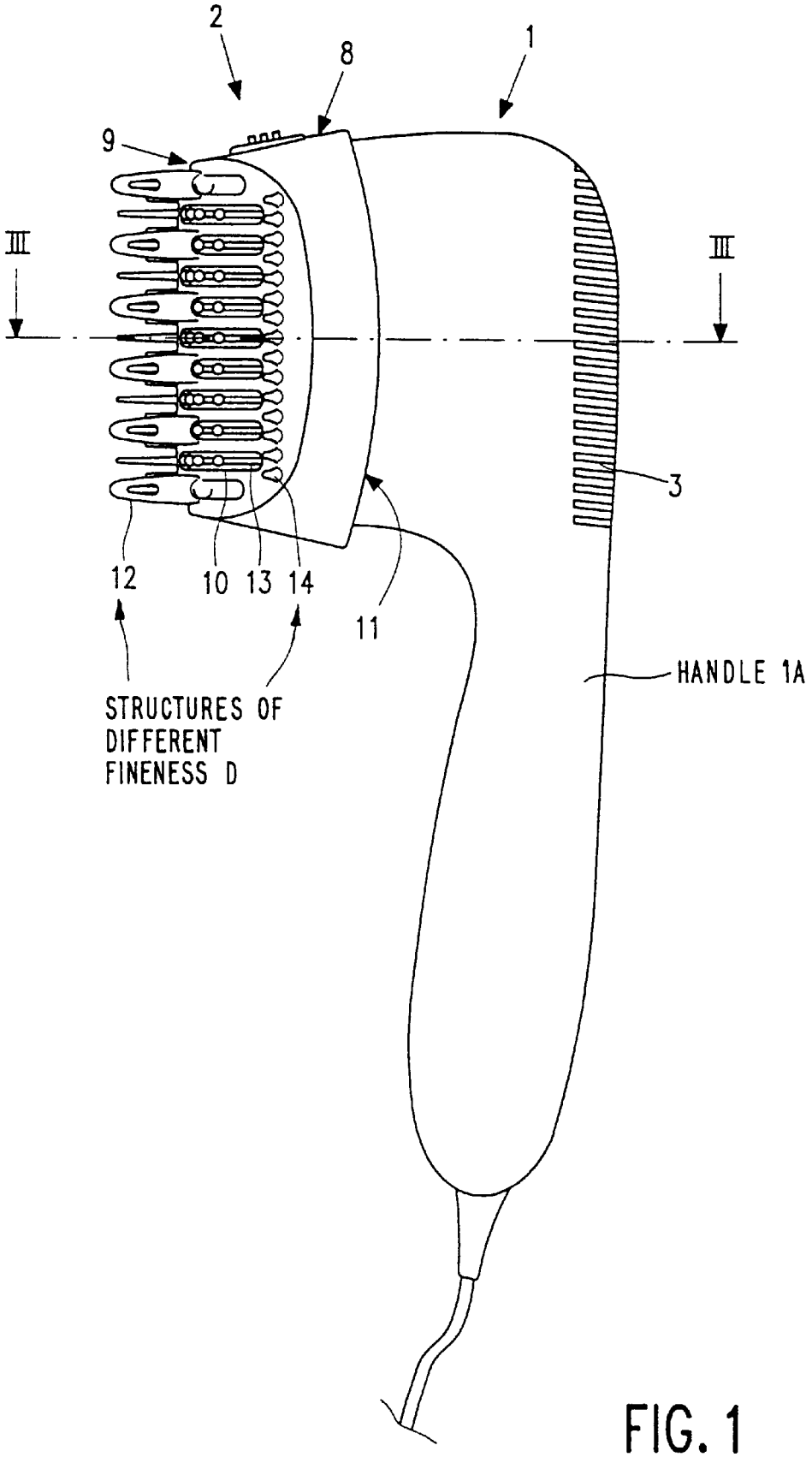
FIG. 1 is a side view showing a hair dryer equipped with a hair styling instrument in accordance with an embodiment of the invention.

Although the proposed hair styling instrument may also be regarded as an assembly of a dryer unit and an attachment or accessory mounted thereon, or as a hair styling instrument with a fixed integrated dryer, it has been assumed that the hair dryer shown—which represents the currently most favored embodiment of the invention—is constituted by a dryer unit 1 and a hair styling instrument 2, which is attached to the dryer unit 1. The hair styling instrument 2 is simply detachable from the unit 1 and can be replaced by other accessories.

The dryer unit 1 has air inlets 3, an air channel 4 adjoining these inlets and, in this air channel 4, a fan 5 and a heating element 6. The air channel 4 of the dryer unit has an outlet opening with a grille comprising a plurality of fins 7 in order to ensure that the heating element 6 cannot be touched when the dryer unit 1 is used without a hair styling instrument 2 being mounted.

The housing 8 of the hair styling instrument 2 has a front side 9 having passages 10 (not all of which bear a reference numeral) to allow heated air from the dryer unit 2 to be discharged from the housing 8.

The housing 8 has a rear side 11, which is remote from the front side 8 and which is constructed as a coupling sleeve for attachment to a dryer unit 3. However, it is alternatively possible to construct the rear of the housing as a handle of a dryer unit, which handle accommodates air inlets, an air channel and, in this air channel, a fan and a heating element for heating the air which passes through.

Elongate hair guides 12, 13, 14 (not all of which bear reference numerals) project from the housing 8 exclusively at the front of this housing 8. Of the hair guides 12, 13, 14 coarse central hair guides 12 and a row of outer hair guides 14, forming combs, are fixedly mounted. The further hair guides 13 are adjustable between a first position, which is shown in the left-hand half of FIG. 2, and a second position, which is shown in the right-hand half of FIG. 2. In the first position the hair guides 13 project fully from the housing 8. In the retracted second position the hair guides 13 do not project at all beyond the outline of the housing 8 in side view.

The retracted second position of the hair guides 13 is particularly suited for treating wet tangly hair because then, i.e. if the hair dryer is not excessively inclined with respect to the outline of the hair, only the hair guide pins 12, which form a coarse hair guide structure, have to be moved through the hair. The resistance presented to the coarse hair guide structure by the wet initially tangly hair and any knots of hair to the coarse hair guide structure is comparatively low, thus enabling the wet tangly hair to be treated properly.

Moreover, as the hair guide pins 12 have air guide channels 15, which extend axially through these pins 12, and slot-shaped radially oriented outlet openings 16, hot air supplied by the dryer unit 1 can penetrate deep into the wet hair. This results in rapid and uniform drying.

In the fully projecting first position of the adjustable hair guides 13 the proposed hair styling instrument is particularly suited for further styling the hair after it has already been dried and ordered slightly. Short hair can also be treated with the adjustable hair guides 13 in the fully projecting position when it is still wet and tangled. The adjustable hair guides 13, which are substantially thinner than the central fixed hair guides 12, form a finer hair guide structure than the central fixed hair guides 12. The porcupine brush structure formed by the adjustable hair guides 13 in their fully projecting positions provides a satisfactory grip on the hair even when it is drier and sleeker and gives the hair a fine and regular structure.

As the pitch between successive central fixed hair guides 12 is greater than the pitch between successive adjustable hair guides 14, a particularly large difference in fineness between the hair guide structure in the case that the adjustable hair guides 13 project and have been retracted is achieved. However, it is also possible to make the fixed and the adjustable hair guides identical. Furthermore, instead of forming adjacent hair guide structures as in the present example, the fixed and the adjustable hair guides can be arranged in a different manner. If the fixed hair guides and the adjustable hair guides in their fully projecting positions are arranged, for example, in an alternating relationship, a single hair guide structure is obtained whose fineness can be varied by adjusting the adjustable hair guides.

Depending on whether the hair is to be styled with finer or coarser hair guides the hair styling instrument can be held parallel to the head or rather at right angles to the head. Since the fine combs formed by the fixed outer hair guides 14 are spaced from the central fixed hair guides 12 and are oriented away from these central fixed hair guides 12, it is possible to style the hair exclusively with the coarse hair guides 12 when the hair guides 13 have been retracted in spite of the fact that also finer fixed hair guides project from the housing 8. This is possible in a particularly effective manner since the fine fixed hair guides 14 end at a distance from a plane defined by the proximal ends of the central fixed hair guides 12.

Since the adjustable hair guides 13 are mounted so as to be wholly retractable into the housing 8, it is achieved that they do not in any way impair the styling of wet tangled hair. However, even when the adjustable hair guides are not mounted so as to be fully retractable into the housing, this may already facilitate the styling of wet and tangled hair.

The adjustable hair guides 13 extend through the passages 10 which allow hot air to pass from the housing 8 to the exterior. Thus, it is achieved that the passages 10 have a large effective area and the design of the housing 8 can be comparatively simple.

The adjustable hair guides 13 are connected to carriers 17 which are pivotably supported in the housing 8 and which each carry one half of the number of adjustable hair guides 13. Each of the carriers 17 and the hair guides 13 carried by them are jointly pivotable between the first position, in which the hair guides 13 project fully (left-hand half of FIG. 2), and the second position, in which the hair guides 13 have been retracted (right-hand half of FIG. 2). Thus, the mobility of the adjustable hair guides is achieved in a constructionally simple manner. The pivotal axes 18 about which the carriers 17 are pivotable are determined by the mounting points 19 in the housing 8.

The pivotal axes 18, about which the carriers 17 are pivotable, extend parallel to one another near opposite sides 20, 21 of the housing 8. In the first position the carriers 17 extend (i.e., or oriented substantially) along the wall of the housing 8 and the hair guides 13 project fully from the housing 8. In the second position the carriers 17 extend from their pivotal axes 18 towards one another. The adjustable hair guides 13 then do not project from the housing 8. Thus, the mobility of the adjustable hair guides 13 is achieved in a constructionally simple manner and an assembly of compact construction is obtained, which is well adapted to the basic shape of the front side 9 of the housing 8, which is shaped as a cylindrical segment.

Figure 3:
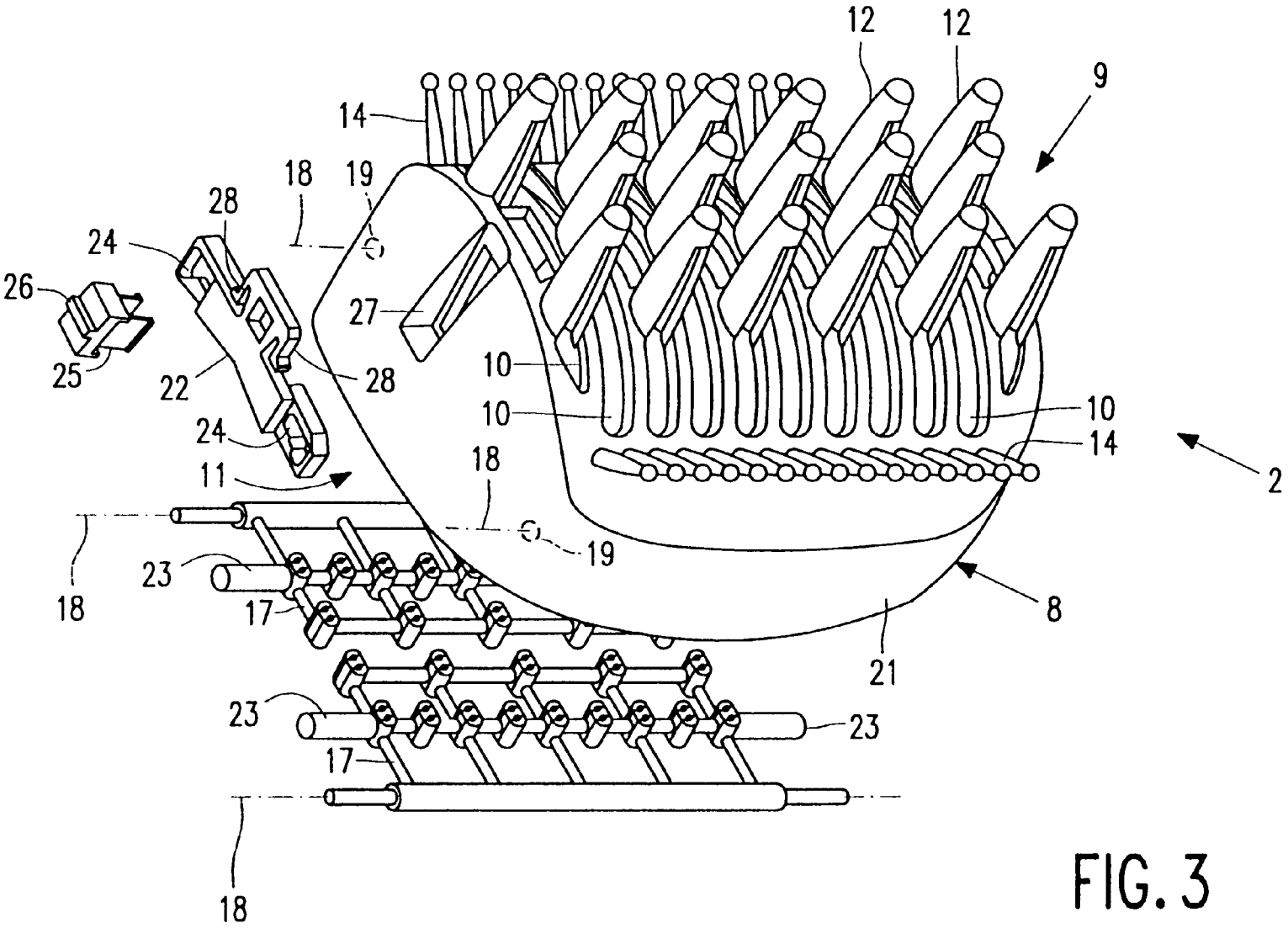
FIG. 3 is a perspective exploded view of at least the larger parts of the hair styling instrument shown in FIGS. 1 and 2.

The construction of the carriers 17 as grids formed by round or at least rounded bar-shaped sections is apparent most clearly from FIG. 3, in which the adjustable hair guides 13 have not been shown for the sake of clarity. In use these grids 17 present a low resistance to the air flow through the housing 8.

Figure 2:
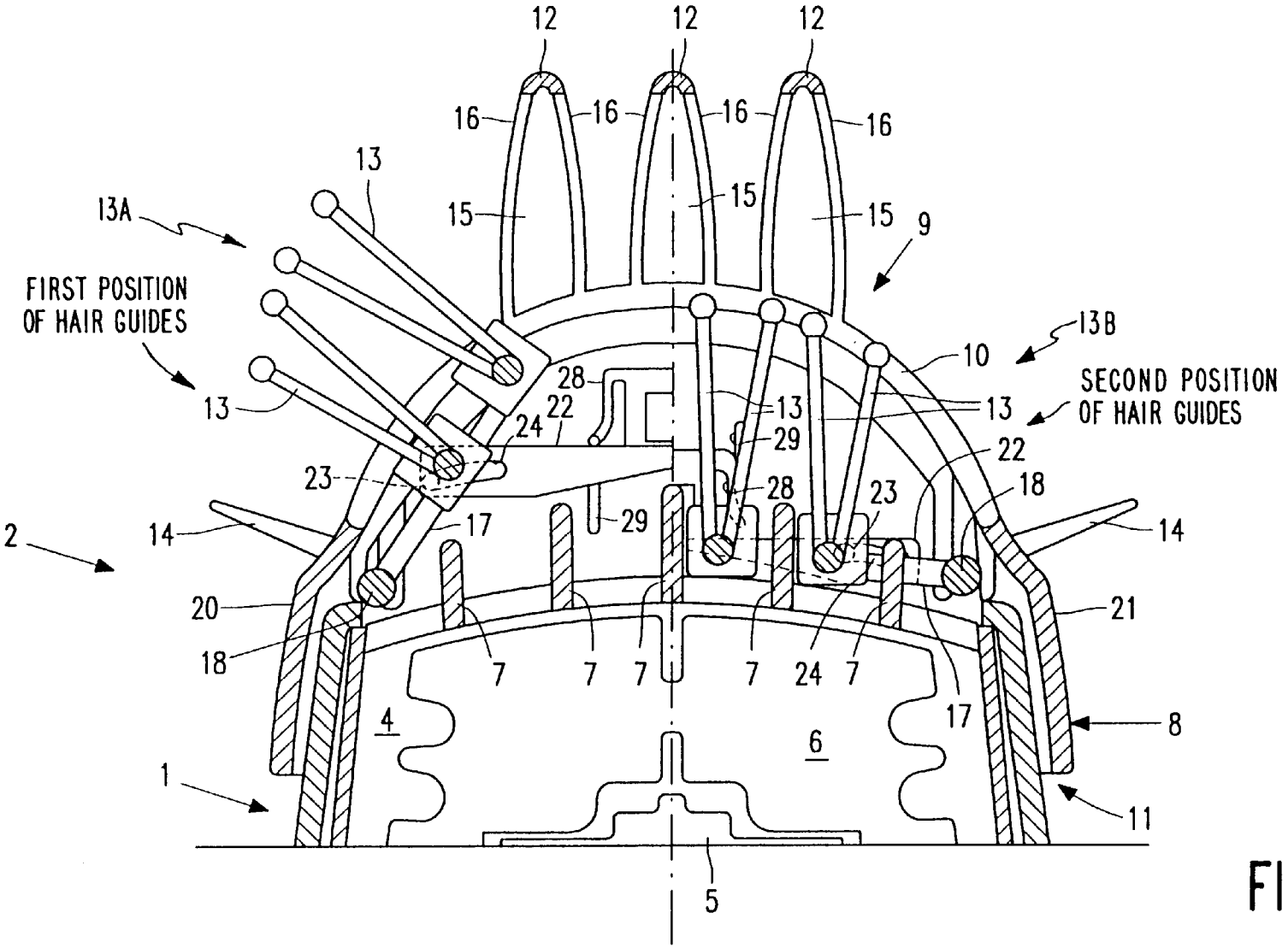
FIG. 2 is a partial side view in a cross-section taken on the line III—III in FIG. 1, the left-hand half showing a first condition of use and the right-hand half showing a second condition of use.

The carriers 17 are coupled by transmission members 22, which are movable between positions in the housing 8 as shown in FIG. 2. For this purpose, the carriers 17 comprise trunnions 23, which extend from these carriers 17 parallel to the pivotal axes 18, and the transmission members 22 have guide slots 24, in which the trunnions 23 engage.

In their turn, the transmission members 22 are coupled to actuating slides 25. The housing 8 has guide slots 27 for guiding the actuating slides 25. The actuating slides 25 partly engage in the guide slots 27 and have actuating projections 26, which project from the guide slots 27 and which can be operated easily by the user.

For locking the adjustable hair guides 13 in the first and the second position the transmission members 22 have resilient fingers 28 and the housing 8 has ribs 29. The shape and the position of these ribs 29 have been selected in such a manner that the fingers 28 are bent when the transmission members 22 are moved from the first position to the second position. As a result of this, a resistance required to bend the resilient fingers 28 should be overcome to move the adjustable hair guides 13 out of the first or the second position. By providing the ribs 29 with one or more recesses intermediate positions can be defined, in which the adjustable hair guides 13 can be locked.

If the adjustable hair guides are locked in an intermediate position, they act upon a smaller part of the hair than in a fully projecting position. By making the adjustable hair guides adjustable between their two extreme positions in steps or continuously, the degree to which they act on the hair during styling can be increased gradually as the hair gets drier.

By means of the lockable transmission members 22 it is achieved that the carriers 17 can be actuated and locked near both ends thereof in a simple manner.

Figure 4:
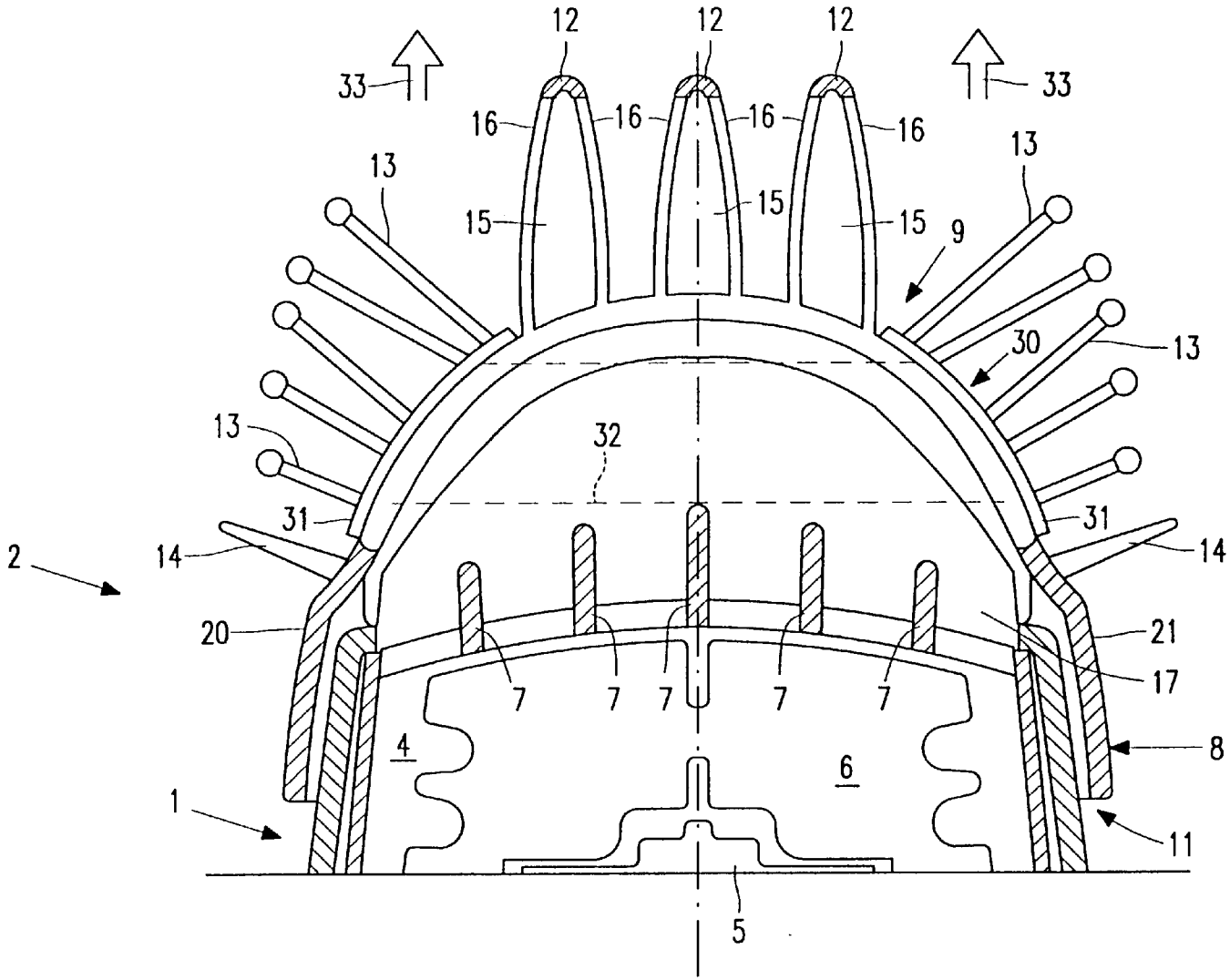
FIG. 4 is a view similar to FIG. 2 and shows a hair dryer equipped with a hair styling instrument in accordance with a second embodiment of the invention.

In the hair styling instrument in accordance with the example shown in FIG. 4 the further hair guides 13 are detachable from the housing 8, as a result of which, when they are not in the said fully projecting first position, they are in another position, i.e. detached from said housing 8. This has the advantage that a very simple construction is obtained. Moreover, in the detached other position the further hair guides 13 present no resistance to the air passing through the passages 10. In comparison with a solution using two attachments with and without a finer hair guide structure as formed by the further hair guides 13, the use of detachable further hair guides has the advantage that only a small additional attachment comprising these detachable further hair guides is required rather than a complete additional attachment. Besides the number of attachment changes during use is halved in comparison with a situation with two complete attachments because only the additional attachment with the further hair guides 13 has to be added or removed and the hair guides 12, 14, which project over a fixed distance, need not be removed or refitted.

The hair styling instrument shown in FIG. 4 further comprises a detachable carrier 30 carrying the further hair guides 13. The carrier 30 comprises two plate-shaped parts 31 having passages corresponding to the passages 10 as regards their location and shape. The plate-shaped parts 31 are interconnected by integrally formed connecting portions 32 which extend along the outside of the housing 8. The carrier 30 is locked to the housing by means of locking fingers (not shown) and is detachable from the housing in the direction indicated by arrows 33.

After perusal of the above description it will be evident to the expert that many variants of the proposed hair styling instrument are possible. For example, the hair styling instrument can be asymmetric or have only one large passage instead of a plurality of small passages. Furthermore, the adjustable hair guides can be movable in accordance with different patterns of movement, such as by translation or by combinations for rotation and translation, which combinations can be characterized by curved centrodes of instantaneous centers of rotation.

We claim:

1. A hair styling instrument comprising a housing having a front side, formed with at least one passage for allowing heated air to pass from the housing, and having a rear side opposite the front side, and elongate hair guides which project exclusively from the front side of the housing wherein at least a plurality of said hair guides is movable between a first position, in which movable hair guides project fully from the housing, and at least a second position, in which the movable hair guides project from the housing at least to a smaller extent than in said first position.

2. A hair styling instrument as claimed in claim 1, in which the rear side of the housing is constructed as an attachment to a dryer unit.

3. A hair styling instrument as claimed in claim 1, in which the rear side of the housing is constructed as a handle of a dryer unit and accommodates air inlets, an air channel and, in said air channel, a fan and a heating element.

4. A hair styling instrument as claimed in claim 1, in which the movable hair guides are arranged so as to be movable into a position in which they have been wholly retracted into the housing.

5. A hair styling instrument as claimed in any claim 1, in which the movable hair guides extend through the at least one passage for allowing heated air to pass from the housing.

6. A hair styling instrument as claimed in claim 1, in which the movable hair guides are movable between said at least two positions, the instrument further comprising locking means for locking the movable hair guides in said at least two positions.

7. A hair styling instrument as claimed in claim 1, further comprising at least one carrier which is pivotably supported in the housing and which carries at least a plurality of the movable hair guides, said at least one carrier and the hair guides carried thereby being jointly pivotable between said at least two positions.

8. A hair styling instrument as claimed in claim 7, in which the number of said carriers is at least two and said at least two carriers are pivotable about pivotal axes which extend near housing sides which are remote from one another between a first position, in which the carriers extend along walls of the housing and the movable hair guides project fully from the housing, and a second position, in which the carriers are oriented substantially from their pivotal axes towards one another and the movable hair guides project from the housing at the most to a smaller extent than in said first position.

9. A hair styling instrument as claimed in claim 7, further comprising a transmission member which can be locked in a first and at least a second position and which acts upon the at least one carrier at a distance from the pivotal axis.

10. A hair styling instrument comprising a housing having at least one passage for allowing heated air to pass from the housing and, in the area of said at least one passage, fixed elongate hair guides which project over a distance from the housing, wherein a plurality of further hair guides which are movable between a first position, in which these movable hair guides project fully from the housing, and at least a second position, in which these movable hair guides project from the housing at least to a smaller extent than in said first position.

11. A hair styling instrument as claimed in claim 10, in which the pitch between at least a plurality of successive fixed hair guides is greater than the pitch between successive ones of said further hair guides.

12. A hair styling instrument as claimed in claim 10, in which said further hair guides in their fully projecting positions project between hair guide structures of different fineness, which are each formed by said fixed hair guides which project from the housing.

13. A hair styling instrument as claimed in claim 10, in which said further hair guides are detached from said housing in said second position.

14. A hair styling instrument as claimed in claim 13, further comprising at least one detachable carrier which carries at least a plurality of said further hair guides.

* * * * *